US010251457B2

(12) United States Patent
Salek

(10) Patent No.: US 10,251,457 B2
(45) **Date of Patent: *Apr. 9, 2019**

(54) LUGGAGE TRANSPORTATION SYSTEM

(71) Applicant: John Salek, Dubai (AE)

(72) Inventor: John Salek, Dubai (AE)

( * ) Notice: Subject to any disclaimer, the term of this patent is extended or adjusted under 35 U.S.C. 154(b) by 104 days.

This patent is subject to a terminal disclaimer.

(21) Appl. No.: 15/149,318

(22) Filed: May 9, 2016

(65) Prior Publication Data

US 2016/0249722 A1 Sep. 1, 2016

Related U.S. Application Data

(63) Continuation of application No. 13/657,020, filed on Oct. 22, 2012, now Pat. No. 9,332,817.

(60) Provisional application No. 61/550,402, filed on Oct. 22, 2011.

(51) Int. Cl.

| | |
|---|---|
| ***A45C 5/14*** | (2006.01) |
| ***A45C 13/30*** | (2006.01) |
| ***A45C 13/38*** | (2006.01) |
| ***A45C 5/03*** | (2006.01) |
| ***A45C 13/26*** | (2006.01) |
| *A45C 7/00* | (2006.01) |

(52) U.S. Cl.

CPC ..... *A45C 13/30* (2013.01); *A45C 5/03* (2013.01); *A45C 5/14* (2013.01); *A45C 13/262* (2013.01); *A45C 13/385* (2013.01); *A45C 7/0045* (2013.01); *A45C 2005/148* (2013.01); *A45C 2013/267* (2013.01); *A45C 2013/306* (2013.01)

(58) Field of Classification Search

CPC ..... A45C 5/14; A45C 13/262; A45C 5/146; A45C 13/385; A45C 3/004

USPC ..... 190/18 A, 18 R, 107–124; 206/287.1; D3/217, 254, 272, 273, 279, 283, 18; 280/43.24, 47.131, 47.17, 47.19, 47.26, 280/47.35, 639, 645, 79.11

See application file for complete search history.

(56) References Cited

U.S. PATENT DOCUMENTS

| | | | | |
|---|---|---|---|---|
| 3,606,372 A | | 9/1971 | Browning | |
| 5,924,533 A | * | 7/1999 | Cnockaert | A45C 5/03 190/109 |

(Continued)

OTHER PUBLICATIONS

Office Action dated Jun. 18, 2014 for U.S. Appl. No. 13/657,020.

(Continued)

*Primary Examiner* — Fenn C Mathew
*Assistant Examiner* — Cynthia Collado
(74) *Attorney, Agent, or Firm* — Kraguwac Law Group LLC

(57) ABSTRACT

Provided is a luggage piece that can be coupled to a second luggage piece to be transported together as a joined unit, and a luggage system including such luggage pieces. The luggage piece includes a housing for storing items to be transported therein, and a retractable handle provided to the housing. A plurality of rollers coupled to the housing allow the luggage piece to be rolled, and include at least two in-line rollers having a generally-fixed rolling direction. The second luggage piece includes two or more adjustable rollers having a variable rolling direction. A plurality of tethers couple the luggage piece and the second luggage piece together to form a joined unit that can be steered through adjustment of the rolling direction of the adjustable rollers.

9 Claims, 4 Drawing Sheets

(56) References Cited

U.S. PATENT DOCUMENTS

| | | | | |
|---|---|---|---|---|
| 6,073,737 | A * | 6/2000 | Kang | A45C 5/14<br>190/113 |
| 7,832,533 | B2 * | 11/2010 | Selvi | A45C 3/001<br>190/103 |
| 2012/0228074 | A1 * | 9/2012 | Osler | A45C 5/14<br>190/18 A |
| 2013/0037364 | A1 * | 2/2013 | Ready | A45C 5/03<br>190/18 A |

OTHER PUBLICATIONS

Office Action dated Sep. 15, 2015 for U.S. Appl. No. 13/657,020.
Notice of Allowance dated Jan. 13, 2016 for U.S. Appl. No. 13/657,020.

* cited by examiner

FIG. 1
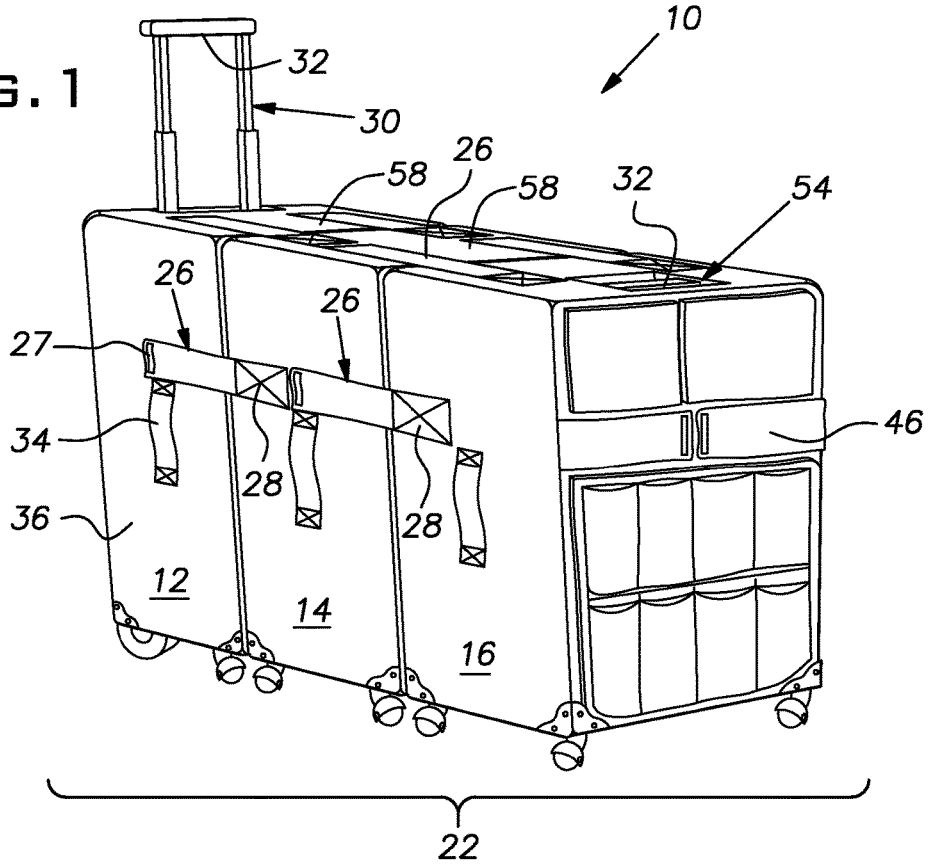
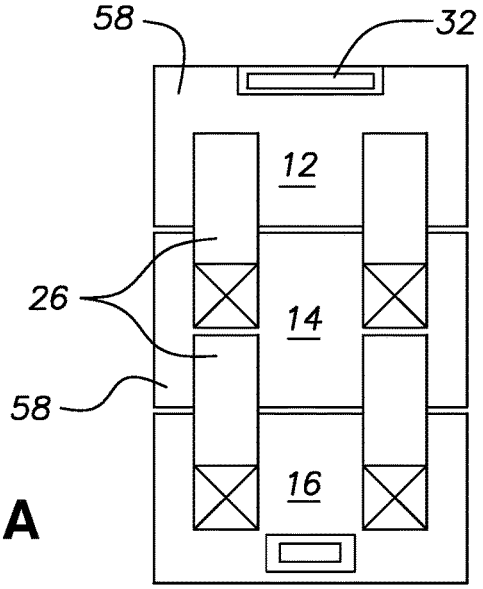
FIG. 1A

LUGGAGE TRANSPORTATION SYSTEM

CROSS-REFERENCE TO RELATED APPLICATIONS

This application claims priority from U.S. patent application Ser. No. 13/657,020, filed Oct. 22, 2012 and the benefit of U.S. Provisional Application No. 61/550,402, filed Oct. 22, 2011, which are incorporated in their entirety herein by reference.

BACKGROUND OF THE INVENTION

1. Field of the Invention

This application relates generally to an apparatus for transporting luggage and, more specifically, to an apparatus for temporarily coupling a plurality of luggage pieces together to simplify transportation of the combined luggage pieces together as a collective unit.

2. Description of Related Art

Travelers have traditionally been required to carry luggage pieces such as carry-on suitcases through airports and other locations while en route to a destination. More recently, such luggage pieces have been provided with wheels to allow travelers to pull such luggage pieces, thereby reducing the physical demands of transporting luggage while traveling.

Although pulling a rolling suitcase is much less demanding of travelers than carrying a suitcase, traveling with more than a single such rolling suitcase requires each suitcase to be pulled separately. This can be a daunting task for a traveler who has packed more than one suitcase for an extended stay at a destination, or when traveling in the company of children who may not be able to pull their own luggage. Such travelers will be required to pull each individual rolling suitcase separately, making it difficult for the travelers to carry anything else such as a coat, airline tickets, or small children.

BRIEF SUMMARY OF THE INVENTION

Accordingly, there is a need in the art for a luggage system that allows a plurality of luggage pieces to be coupled together and collectively transported together as a unit.

According to one aspect, the subject application involves a luggage piece that can be coupled to a second luggage piece to be transported with the second luggage piece as a joined unit. The second luggage piece includes a plurality of adjustable rollers having a variable rolling direction, where the luggage piece includes a housing defining an interior compartment that stores items to be transported within the luggage piece. A retractable handle is provided to the housing, and is adjustable between a recessed position where a handgrip provided to the handle is disposed proximate to the housing and a deployed position where the handgrip is extended distally away from the housing. A plurality of rollers are coupled to the housing on which the luggage piece is to be rolled. Among the plurality of rollers are at least two in-line rollers having a generally fixed rolling direction. A coupling system includes a plurality of tethers that cooperate with one or more receivers provided to the second luggage piece to couple the second luggage piece to the luggage piece at a position that allows the joined unit to roll on the in-line rollers and the adjustable rollers. The adjustable rollers provided to the second luggage piece afford the joined unit a steering capability.

According to another aspect, the subject application involves a luggage system that includes a first luggage piece and a second luggage piece. The first luggage piece includes a housing defining an interior compartment that stores items to be transported within the first luggage piece. A retractable handle is adjustable between a recessed position where a handgrip provided to the handle is disposed proximate to the housing and a deployed position where the handgrip is extended distally away from the housing. Two or more rollers are coupled to the housing on which the luggage piece is to be rolled, and include at least two in-line rollers having a generally fixed rolling direction. The second luggage piece includes a housing defining an interior compartment that stores items to be transported within the second luggage piece, and a retractable handle that is adjustable between a recessed position where a handgrip provided to the handle is disposed proximate to the housing and a deployed position where the handgrip is extended distally away from the housing. A plurality of rollers are coupled to the housing on which the second luggage piece is to be rolled, including at least two adjustable rollers having a variable rolling direction. A coupling system including a plurality of tethers couples the first and second luggage pieces together to be rolled on the at least two in-line rollers and the at least two adjustable rollers together as a joined unit. The joined unit is steerable through adjustment of the variable rolling direction of the adjustable rollers.

According to another aspect, the subject application involves a luggage system that includes a first luggage piece and a second luggage piece that can be coupled together to form a joined unit. The first luggage piece includes a housing defining an interior compartment for storing items to be transported within the first luggage piece, and a retractable handle. The retractable handle is adjustable between a recessed position where a handgrip provided to the handle is disposed proximate to the housing and a deployed position where the handgrip is extended distally away from the housing of the first luggage piece. A plurality of rollers are coupled to the housing to facilitate rolling of the first luggage piece, and include at least two in-line rollers having a generally fixed rolling direction and at least two adjustable rollers having a variable rolling direction. The in-line rollers extend from a bottom surface of the first luggage piece adjacent to a vertical plane in which the retractable handle of the first luggage piece is located and the adjustable rollers extend from a bottom surface of the first luggage piece adjacent to a side of the bottom surface opposite the in-line rollers. The second luggage piece includes a housing defining an interior compartment for storing items to be transported within the second luggage piece. A retractable belt is stored about a spool coupled to the housing of the second luggage piece and comprises a handgrip provided adjacent to a distal end of the retractable belt. The retractable belt is adjustable between a recessed position where the handgrip is disposed proximate to the housing of the second luggage piece and a deployed position where the handgrip is extended distally away from the housing of the second luggage piece. A plurality of adjustable rollers having a variable rolling direction are arranged to extend from a bottom surface of the second luggage piece to allow the second luggage piece to roll on the adjustable rollers. The bottom surface of the second luggage piece is devoid of any in-line rollers. A coupling system comprising a plurality of tethers that extend between the first and second luggage pieces are provided to couple the first and second luggage pieces together to be rolled on the in-line rollers and the adjustable rollers together as a joined unit. A proximate portion of the joined unit adjacent to the in-line rollers has a tendency to roll in a fixed direction established by the in-line rollers and a distal portion of the joined unit adjacent to the adjustable rollers of the second luggage piece is steerable in a plurality of different directions through adjustment of the variable rolling direction of the adjustable rollers without skidding the adjustable rollers in a manner that would otherwise occur if the adjustable rollers had a fixed rolling direction.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein:

FIG. 1 and FIG. 1A show a perspective view an illustrative embodiment of a luggage system comprising a plurality of luggage pieces collectively forming a joined unit, and an inset top view of the joined unit;

DETAILED DESCRIPTION OF THE INVENTION

Figure 2:
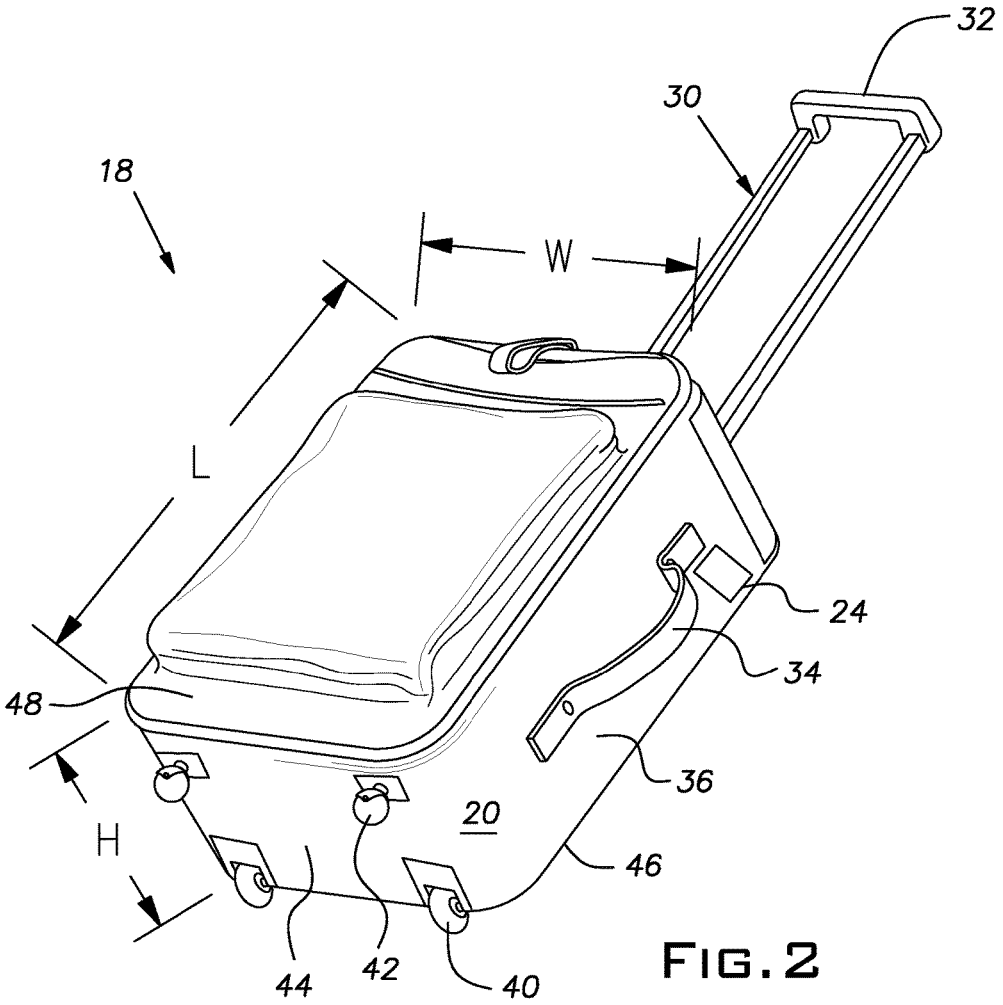
FIG. 2 shows a perspective view of an illustrative embodiment of a luggage piece separate from the joined unit and including a plurality of rollers.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

An illustrative embodiment of a luggage system 10 is shown in FIG. 1 and FIG. 1A. As shown, the luggage system 10 includes a plurality of luggage pieces 12, 14, 16. Each luggage piece 12, 14, 16 can be what is commonly referred to as a "carry-on bag" (an example of which is shown in FIG. 2, and referred to generally at 18), as defined by commercial airlines and sized to be hand carried by a passenger onto a commercial aircraft and stored in an overhead bin of the commercial aircraft or under the seat in front of the seat in which the passenger is to be seated. Although the size limits for carry-on bags 18 can vary by commercial airline, an example of the maximum allowable external dimensions of a carry-on bag is a total dimension (i.e., the sum of the length (L)+width (W)+height (H)) of the housing 20 of fifty five inches (55 in.) or smaller, or fifty one inches (51 in.) or smaller. According to other embodiments, the maximum allowable total dimension of the housing 20 of a carry-on bag 18 is forty five inches (45 in.).

Other airlines may impose a maximum size limit on each individual dimension of an acceptable carry-on bag 18. For instance, the maximum external dimensions of the housing 20 of an acceptable carry-on bag 18 according to such embodiments can be limited to no more than twenty six four inches (24 in.), by sixteen inches (16 in.), by ten inches (10 in.) (i.e., 24 in.×16 in.×10 in.). According to alternate embodiments, the maximum dimensions of the housing 20 of an acceptable carry-on bag 18 can be limited to no more than twenty two inches (22 in.), by fourteen inches (14 in.), by ten inches (10 in.) (i.e., 22 in.×14 in.×10 in.).

Figure 5:
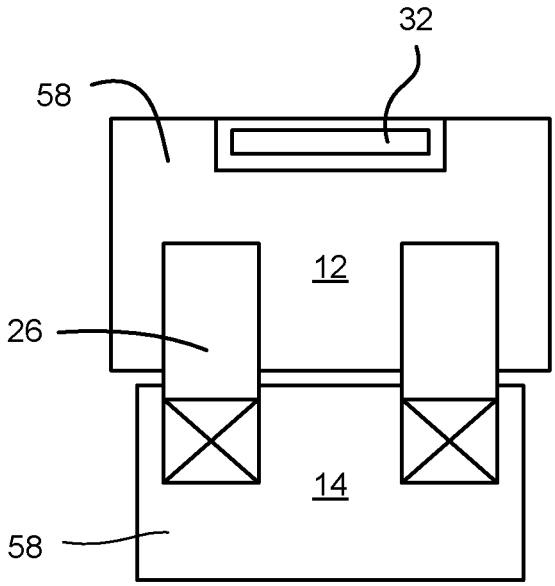
FIG. 5 shows a top view of an illustrative embodiment of a joined unit of luggage pieces comprising a plurality of luggage pieces with different exterior dimensions.

According to yet other embodiments, the maximum allowable external dimension(s) of an acceptable carry-on bag 18 can optionally be established by one or more regulation(s) promulgated by a governing body or trade association of the commercial airline industry such the U.S. Federal Aviation Administration. Although the luggage pieces 12, 14, 16 coupled together to collectively form a single, joined unit 22 are described herein as being carry-on bags 18, the present invention is not so limited. Instead, each luggage piece 12, 14, 16 can independently be selected as a carry-on bag 18, a suitcase having dimensions greater than those allowable for carry-on bags 18, or a combination thereof. However, for the sake of brevity, the luggage system 10 will be described herein as comprising at least two, and optionally three luggage pieces 12, 14, 16 in the form of carry-on bags 18, as shown in FIG. 5.

As shown in FIG. 2, the carry-on bag 18 includes a housing 20 defining an interior compartment for storing items to be transported within the carry-on bag 18. The housing 20 can include a substantially rigid shell formed from sides arranged in a generally-cubicle formation, although each side does not necessarily have the same identical dimension. As an illustrative example, the carry-on bag 18 can include the dimensions of about: twenty two inches (22 in.) in length (L), fourteen inches (14 in.) in width (W), and ten inches (10 in.) in height (H) (i.e., 22 in.×14 in.×10 in.), but other dimensions are within the scope of the present disclosure. Further, each carry-on bag 18 included as one of the luggage pieces 12, 14, 16 can have approximately the same dimensions and/or internal storage volume, or different dimensions that are less than the maximum allowable dimensions of a carry-on bag 18.

The externally-exposed surfaces of the housing 20, or at least portions thereof, can include connection regions 24 that can cooperate with a tether 26 (FIG. 1) as described in detail below to couple at least two, and optionally three or more luggage pieces 12, 14, 16 together to form the joined unit 22. For example, the externally-exposed surfaces can include a patch of material forming a first portion of a hook-and-loop fastening system commonly referred to by the trademark Velcro®, for example, as the connection region 24 (FIG. 2). The compatible, mating portion of the hook-and-loop fastening system can be supported adjacent to a distal end 28 (FIG. 1) of the tether 26 that extends away from the housing 20. According to alternate embodiments, the connection region 24 can include a portion of a buckle, snap, or any other releasable mechanical fastener that can be engaged by a portion of the tether 26 to establish a friction-fit connection that couples the distal end. Although the connection region 24 is shown in FIG. 2 as a well-defined portion that encompasses less than a significant portion of the housing 20, it is to be understood that the connection region 24 can optionally include any portion of the housing's surface area. For instance, a housing 20 having a fabric exterior surface can receive the mating portion of the hook-and-loop fastener at approximately any location on the exposed fabric. Thus, the connection region 24 can include an isolated region of the housing 20, or anywhere on the housing 20 where a suitable and compatible fastening component is available.

According to alternate embodiments, a system comprising a magnetic and a magnetically-attractive material can be provided as the connection region 24 and the compatible, mating portion provided adjacent to the distal end 28 of the tether 26. Magnetic attraction between the magnet and magnetically-attractive portion serves to releasably couple the distal end 28 of the tether 26 to the connection region 24, and thereby couple immediately adjacent luggage pieces together as described below. Regardless of the particular materials used, the fastening system provided to the connection region 24 and the distal end 28 of the tether(s) 26 releasably couples the distal end 28 of the tether 26 extending from one carry-on bag 18 to an immediately-adjacent carry-on bag 18. As a releasable coupling, the distal end 28 of the tether 26 can repeatedly be connected, by hand, and subsequently removed to/from its corresponding connection region 24 provided to the immediately adjacent (e.g., not separated from each other by an intervening carry-on bag 18) carry-on bag 18 without damaging the tether 16, the connection region 24 or the carry-on bag 18 to an extent that renders any such components unfit for subsequent usage.

The one tether 26, or plurality of tethers 26 can optionally include a permanent tether 26 that is affixed to at least one, and optionally each of the carry-on bags 18 included in the luggage system 10, in a non-releasable manner. The permanent tether 26 prevents removal of the tether 26 without damaging the permanent tether 26 itself, or the carry-on bag 18 to which it is affixed. For example, one or more of the tethers 26 can be stitched using nylon thread or other suitable stitching 27 to a first luggage piece 12 (FIG. 1), for example. According to alternate embodiments, a proximate end of the permanent tether 26 can be adhesively coupled to the housing 20 of the first luggage piece 12, or secured to be spooled about a spool provided to the first luggage piece 20, for example. When not coupling luggage pieces together, the distal end 28 of the tether 26 can optionally cooperate with a portion of the housing 20, or can otherwise be supported or stowed on the housing of the luggage piece to which the tether 26 is affixed in a manner that does not interfere with use of that luggage piece by itself, separate from the other luggage pieces.

Additionally, the tethers 26 are described herein as being straps of a flexible material such as nylon or the like. However, it is to be understood that any suitable fastener (e.g., plastic, metal or other rigid braces; elastic bands; etc. . . . ) that can extend between the luggage pieces 12, 14, 16 described herein can be utilized without departing from the scope of the present invention.

Each carry-on bag 18 can optionally also include a retractable handle 30 (FIG. 2) that is adjustable relative to the housing 20 between a recessed position, where a handgrip 32 provided to the handle 30 is disposed adjacent to the housing 20, and a deployed position where the handgrip 32 is extended distally away from the housing 20. As shown in FIG. 2, the handle 30 is adjustable in a vertically-oriented plane that extends substantially parallel to the length (L) of the housing 20. Further, an additional, fixed handle 34 can optionally be provided to a lateral side 36 of the housing 20 to facilitate lifting and transportation of the carry-on bag 18 by hand, with the length oriented in a substantially-horizontal orientation.

According to alternate embodiments, each luggage piece 12, 14, 16 can optionally include substantially the same type of handle, which is shown in FIG. 2 as a generally U-shaped handle (the handgrip 32 forming the bridge between the downward facing sides of the U). According to alternate embodiments, the first luggage piece 12 can optionally include the telescopically-retractable U-shaped handle 30, while another luggage piece 16, for example, includes a retractable belt handle 54 (FIG. 1), or a handle including a single, telescopically adjustable arm with the handgrip supported thereon. The belt handle 54 includes a belt of nylon or other suitable material that is stored about a spool coupled to the housing 20, and a handgrip 32 provided to a distal end of the retractable belt. The spool can optionally be recessed within a portion of the housing 20 to be concealed from view when the housing 20 is observed. Like the U-shaped embodiment of the handle 32, the retractable belt is adjustable relative to the housing 20 between a recessed position where the handgrip 32 is disposed proximate to the housing 20 and a deployed position where the handgrip 32 is extended distally away from the housing 20.

The carry-on bag 18 also includes a plurality of rollers 40, 42 that extend downwardly, and/or protrude from a bottom surface 44 of the housing 20 that is positioned to oppose a ground surface on which the carry-on bag 18 rests when standing upright, with the handle 30 extending in a substantially-vertical orientation. As shown in FIG. 2, the plurality of rollers 40, 42 includes at least two, and optionally more, in-line rollers 40 arranged along a proximate side 46 of the housing 20 adjacent to the vertical plane in which the handle 30 extends and retracts. Each of the in-line rollers 40 can include a wheel that rotates about an axle having a fixed rolling direction, which does not pivot or otherwise change in response to a change of direction in which the carry-on bag 18 is rolling while being pulled with the handle 30.

The plurality of rollers 40, 42 of the carry-on bag 18 in FIG. 2 also include at least two, and optionally more, adjustable rollers 42. The adjustable rollers 42 also extend downwardly beyond the bottom surface 44 of the housing, but are arranged closer to a vertical plane in which a distal, or front side 48 of the housing 20, opposite the proximate side 46 of the housing 20 adjacent to the vertical plane in which the handle 30 extends and retracts, is located. Each of the adjustable rollers 42 includes a wheel, ball, caster, or other suitable rolling device that rotates about an axis of rotation having an adjustable rolling direction, which pivots or otherwise changes in response to a change of direction in which the carry-on bag 18 is rolling while the adjustable rollers 42 are in contact with the ground. Thus, the adjustable rollers 42 can maintain contact with the ground and allow the distal side 48 of the carry-on bag 18 to be turned or otherwise steered while the carry-on bag 18 is rolling on all of the rollers 40, 42, without dragging or otherwise skidding rollers as would occur if the adjustable 42 rollers adjacent to the distal side 48 of the housing 20 were replaced with in-line rollers. In other words, and with reference to FIG. 3, which is a view looking up at an embodiment of the bottom surface 44 of the housing 20, the adjustable rollers 42 rotate about an axis 50, which can pivot in the directions indicated by arrow 52 depending upon the direction in which the carry-on bag 18 is being steered while the adjustable rollers 42 are in contact with the ground.

Figure 3:
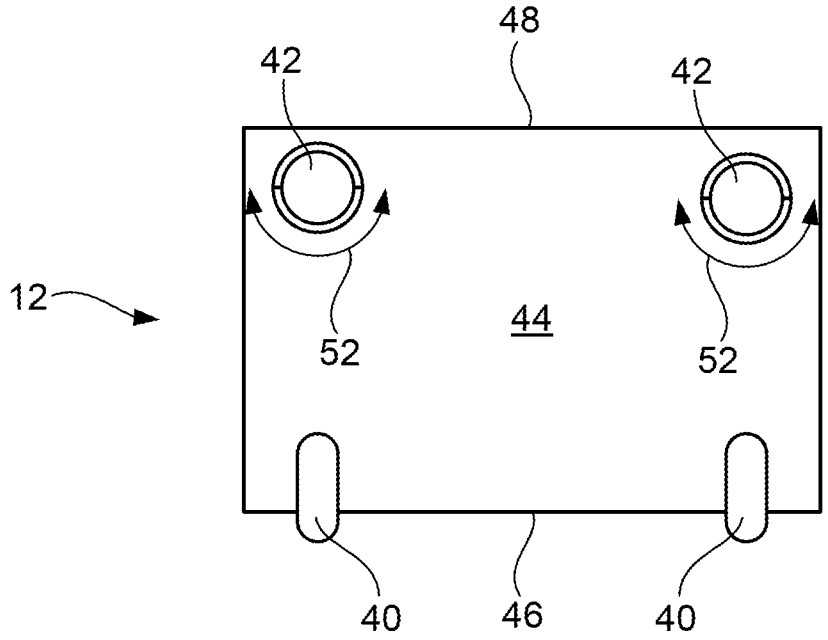
FIG. 3 shows a bottom view of an illustrative embodiment of a luggage piece comprising a combination of in-line rollers and adjustable rollers.

The plurality of rollers provided to each of the luggage pieces 12, 14, 16 in included in the luggage system 10 FIG. 1 can be independently selected to include a plurality of in-line rollers 40, a plurality of adjustable rollers 42, or a plurality of in-line rollers 40 and a plurality of adjustable rollers 42. For example, as illustrated in FIGS. 1 and 3, the first luggage piece 12 can include a plurality of in-line rollers 40 arranged along a proximate side 46 of the housing 20. The first luggage piece 12 also includes a plurality of adjustable rollers 42 arranged adjacent to the distal side 48 of the housing. The in-line rollers 40 of the first luggage piece 12 allow the first luggage piece 12 to track in a substantially straight line, while the adjustable rollers 42 allow the first luggage piece to be turned in a manner similar to a car, where the adjustable rollers 42 allow the distal side 48 to be steered while the in-line wheels 40 follow.

Figure 4:
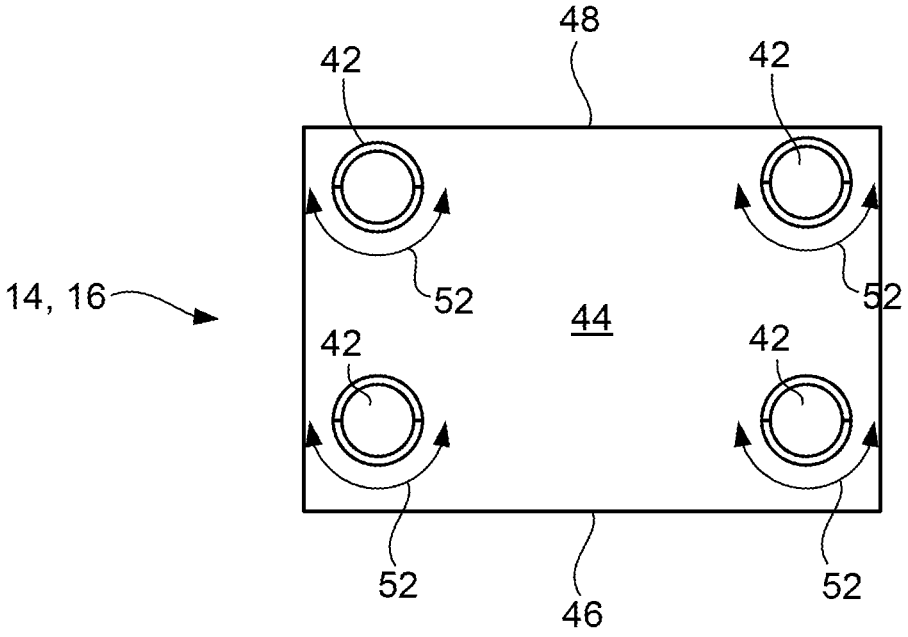
FIG. 4 shows a bottom view of an illustrative embodiment of a luggage piece comprising only adjustable rollers.

In contrast, the other luggage pieces 14, 16 included in the luggage system 10 collectively forming the joined unit 22 illustrated in FIG. 1 can each include a plurality of adjustable rollers 42, such as four, arranged along the bottom surface 44 of the housing as illustrated in FIG. 4, for example. According to such an embodiment, the luggage pieces 14, 16 each include only adjustable rollers 42, without any in-line rollers 40, to allow the luggage pieces 14, 16 to be freely rotated without the tracking ability afforded by the in-line rollers 40.

In use, the luggage piece 12 can be positioned immediately adjacent to another luggage piece 14 (e.g., physically abutting against each other). The distal side 48 (FIGS. 2 and 3) of the luggage piece 12 can be placed against, or at least opposing the distal side 48 of the luggage piece 14. Thus, the proximate side 46 of the luggage piece 12 adjacent to the handle 30 forms a first terminal end of the joined unit 22, and the proximate side 46 of the luggage piece 14 adjacent to the handle 30 provided to that luggage piece 14 forms another terminal end of the joined unit 22 along a longitudinal axis. Arranged in such a manner, the handle 30 provided to each luggage piece 12, 14 is arranged adjacent to a terminal end to allow access to a handle 30 regardless of which end a user is standing next to. One, or a plurality of tethers 26 can be extended between the luggage piece 12 and the luggage piece 14, and the mating portion of the fastening system supported by the distal end of the tether 26 introduced to the connection portion 24 provided to the housing of the luggage piece 14, thereby coupling the luggage pieces 12, 14 together. As shown in FIG. 1, four tethers 26 are used to couple the luggage pieces 12, 14 together: one tether 26 on each lateral side 36 of the housing 20, and two tethers 26 extending between a top surface 58 of each of the luggage pieces 12, 14. Of course any number of tethers 26 suitable to couple the luggage pieces 12, 14 together and maintain their close relative positioning while being rolled and steered as the joined unit 22 can be utilized without departing from the scope of the present invention.

In a like manner, the luggage piece 16 can also be positioned adjacent to the luggage piece 14, and coupled thereto with a plurality of tethers 26 to form a joined unit 22 comprising three luggage pieces 12, 14, 16 as shown in FIG. 1. With the in-line rollers 40 arranged at one longitudinal end of the joined unit 22, the joined unit 22 can be pulled by the retractable belt handle 54 and follow, tracking in a substantially straight line as a result of the fixed steering direction of the in-line rollers 40. The other terminal end of the joined unit 22, adjacent to the adjustable rollers 42 provided to the proximate side 46 of the luggage piece 16 as shown in FIG. 1, can be steered through adjustment of the rolling direction of the adjustable rollers 42 without dragging or skidding fixed-rolling-direction rollers in a direction other than their fixed rolling direction. Each of the rollers disposed along the joined unit 22 between the in-line rollers 40 provided adjacent one terminal end and the adjustable rollers 42 provided adjacent the opposite terminal end can be adjustable rollers to facilitate steering of the opposite terminal end without dragging or skidding fixed-rolling-direction rollers in a direction other than their fixed rolling direction.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A luggage system comprising:

a first luggage piece comprising:

a housing defining an interior compartment that stores items to be transported within the first luggage piece, the housing comprising a bottom surface, a vertically-oriented proximate side that extends upwardly from the bottom surface and is positioned adjacent to a user while the luggage piece is being pulled by the user, and a vertically-oriented distal side that extends upwardly from an opposite side of the bottom surface relative to the proximate side, a retractable handle that is adjustable between a recessed position where a handgrip provided to the handle is disposed proximate to the housing and a deployed position where the handgrip is extended distally away from the housing, the retractable handle being adjustable in a plane adjacent to, and substantially-parallel with the proximate side of the housing, and a plurality of rollers coupled to the bottom surface of the housing on which the luggage piece is to rest in an upright orientation, the plurality of rollers comprising at least two adjustable rollers having a variable rolling direction;

a second luggage piece comprising:

a housing defining an interior compartment that stores items to be transported within the second luggage piece, the housing comprising a bottom surface, a vertically-oriented proximate side that extends upwardly from the bottom surface and is positioned adjacent to a user while the luggage piece is being pulled by the user, and a vertically-oriented distal side that extends upwardly from an opposite side of the bottom surface relative to the proximate side, wherein the housing of the second luggage piece comprises different dimensions defining a different internal storage volume relative to dimensions and an internal volume of the first luggage piece, a retractable handle that is adjustable between a recessed position where a handgrip provided to the handle is disposed proximate to the housing and a deployed position where the handgrip is extended distally away from the housing, the retractable handle being adjustable in a plane adjacent to, and substantially-parallel with the proximate side of the housing of the second luggage piece, and a plurality of rollers coupled to the bottom surface of the housing on which the second luggage piece is to be rolled, the plurality of rollers comprising at least two adjustable rollers having a variable rolling direction; and a coupling system comprising a plurality of tethers that couple the first and second luggage pieces together to form a joined unit, wherein the joined unit is to be rolled on the plurality of rollers coupled to the bottom surface of the housing provided to the first luggage piece and the plurality of rollers coupled to the bottom surface of the housing provided to the second luggage piece, wherein the joined unit is steerable through adjustment of the variable rolling direction of the adjustable rollers provided to the first luggage piece and the second luggage piece.

2. The luggage system of claim 1 further comprising a third luggage piece that the tethers couple between the first luggage piece and the second luggage piece as part of the joined unit.

3. The luggage system of claim 2, wherein the third luggage piece comprises a plurality of adjustable rollers having a variable rolling direction.

4. The luggage system of claim 3, wherein the third luggage piece comprises a retractable handle that is adjustable between a retracted position and an extended position, wherein the handle provided to the third luggage piece comprises a single frame member.

5. The luggage system of claim 1, wherein the second luggage piece, while coupled to the first luggage piece to form a portion of the joined unit, is configured so the proximate surface of the housing of the second luggage piece is arranged adjacent to, and opposes the distal surface of the housing of the first luggage piece.

6. The luggage system of claim 1, wherein the plurality of rollers coupled to the housing of the first luggage piece further comprises a plurality of adjustable rollers that are coupled to the housing of the first luggage piece adjacent to a panel of the housing of the first luggage piece that opposes a panel of the housing of the second luggage piece when the first and second luggage pieces are coupled together to form the joined unit.

7. The luggage system of claim 1, wherein the plurality of tethers comprises a permanent tether that is affixed to the first luggage piece or the second luggage piece in a non-releasable manner that prevents removal of the permanent tether without damaging the first luggage piece, the second luggage piece or the permanent tether.

8. The luggage system of claim 7, wherein the permanent tether is affixed to the first luggage piece or the second luggage piece by at least one of stitching and an adhesive.

9. The luggage system of claim 7, wherein a connector portion of the permanent tether is secured to a portion of the housing of the first luggage piece or the second luggage piece to which the permanent tether is affixed when the permanent tether is not coupling the first and second luggage pieces together.

* * * * *